US008776380B1

(12) United States Patent
Quimby et al.

(10) Patent No.: US 8,776,380 B1
(45) Date of Patent: Jul. 15, 2014

(54) UTILITY KNIFE WITH RETRACTABLE BLADE

(76) Inventors: Elwood Dean Quimby, Derby, KS (US); Hubert Josef Bung, Wichita, KS (US)

( * ) Notice: Subject to any disclaimer, the term of this patent is extended or adjusted under 35 U.S.C. 154(b) by 51 days.

(21) Appl. No.: 13/455,794

(22) Filed: Apr. 25, 2012

Related U.S. Application Data

(60) Provisional application No. 61/517,700, filed on Apr. 25, 2011.

(51) Int. Cl.
*B26B 1/02* (2006.01)
*B26B 1/10* (2006.01)

(52) U.S. Cl.
USPC ..... 30/155; 30/156; 30/158

(58) Field of Classification Search
CPC ..... B26B 1/02; B26B 1/08; B26B 1/10; B26B 3/06; B26B 5/001; B26B 5/003
USPC ..... 30/2, 153, 155–158, 162–163, 319; D8/99
See application file for complete search history.

(56) References Cited

U.S. PATENT DOCUMENTS

| | | | | | |
|---|---|---|---|---|---|
| 978,165 | A | | 12/1910 | Johnson | |
| 1,768,537 | A | * | 7/1930 | Alexander | 30/171 |
| 1,850,090 | A | | 3/1932 | Alexander et al. | |
| 2,248,796 | A | | 7/1941 | Vosbikian et al. | |
| 2,542,582 | A | | 2/1951 | Schwork | |
| 2,835,031 | A | | 5/1958 | Cook et al. | |
| 3,037,342 | A | | 6/1962 | Dyer | |
| 3,577,637 | A | * | 5/1971 | Braginetz | 30/162 |
| 3,641,667 | A | * | 2/1972 | Leopoldi | 30/2 |
| 3,708,881 | A | * | 1/1973 | Bennett | 30/320 |
| 3,879,847 | A | * | 4/1975 | Roll | 30/162 |
| 4,077,124 | A | | 3/1978 | Christmann | |
| 4,277,888 | A | * | 7/1981 | Szabo | 30/162 |
| 4,340,327 | A | * | 7/1982 | Martins | 408/59 |
| 4,592,113 | A | | 6/1986 | Selfors | |
| 4,683,656 | A | * | 8/1987 | Peyrot et al. | 30/162 |
| 4,713,885 | A | * | 12/1987 | Keklak et al. | 30/162 |
| 4,745,653 | A | | 5/1988 | Bliznak | |

(Continued)

FOREIGN PATENT DOCUMENTS

| | | | |
|---|---|---|---|
| CA | 2500489 | A1 * | 12/2004 |
| CA | 2150361 | C * | 2/2005 |

(Continued)

*Primary Examiner* — Jason Daniel Prone
(74) *Attorney, Agent, or Firm* — Law Office of Mark Brown, LLC; Christopher M. DeBacker; Mark E. Brown

(57) ABSTRACT

A retractable blade knife includes a body, a handle lever and a blade holder assembly. The blade holder assembly is mounted to the distal end of the body to pivot between a retracted position in which a cutting edge is concealed within the body and an extended position in which a cutting edge is exposed. The handle lever is mounted to the body at a pivot joint that is located between the opposite ends of both the lever member and the body so that the handle lever can pivot between an open position and a closed position. A pin at the distal end of the handle lever is received for sliding movement by a slot in the blade holder assembly so that when the handle lever is urged from the open position to the closed position, the blade holder assembly rotates from the retracted position to the extended position.

14 Claims, 18 Drawing Sheets

(56) References Cited

U.S. PATENT DOCUMENTS

| | | | | |
|---|---|---|---|---|
| 5,285,574 | A * | 2/1994 | Feltner | 30/2 |
| 5,303,474 | A | 4/1994 | Keklak et al. | |
| 5,426,855 | A * | 6/1995 | Keklak et al. | 30/162 |
| 5,557,852 | A | 9/1996 | Frisina | |
| 5,613,300 | A * | 3/1997 | Schmidt | 30/2 |
| 5,636,845 | A | 6/1997 | Newnam | |
| 5,665,169 | A * | 9/1997 | Lisle et al. | 134/6 |
| 5,711,077 | A * | 1/1998 | Schulz et al. | 30/160 |
| 5,960,545 | A * | 10/1999 | Shepherd et al. | 30/125 |
| 6,205,667 | B1 * | 3/2001 | Glesser | 30/162 |
| 6,243,952 | B1 | 6/2001 | Holcomb et al. | |
| 6,314,646 | B1 * | 11/2001 | Schmidt | 30/162 |
| 6,321,454 | B1 | 11/2001 | Wass | |
| D462,250 | S | 9/2002 | Ping | |
| 6,550,144 | B1 * | 4/2003 | Berns | 30/162 |
| 6,643,936 | B2 * | 11/2003 | Carlson et al. | 30/162 |
| 6,813,833 | B2 * | 11/2004 | Saunders et al. | 30/162 |
| 6,848,185 | B2 | 2/2005 | Tebo | |
| 7,305,770 | B2 * | 12/2007 | Critelli et al. | 30/162 |
| 7,322,110 | B2 * | 1/2008 | Hernandez et al. | 30/162 |
| 7,356,928 | B2 * | 4/2008 | Votolato | 30/153 |
| 7,765,701 | B2 * | 8/2010 | Okada | 30/162 |
| 7,921,568 | B2 | 4/2011 | Green | |
| 8,056,241 | B2 | 11/2011 | Davis et al. | |
| 8,122,605 | B2 * | 2/2012 | Votolato | 30/156 |
| 8,220,160 | B2 * | 7/2012 | Davis et al. | 30/162 |
| 8,250,764 | B2 * | 8/2012 | Davis et al. | 30/162 |
| 8,307,556 | B2 * | 11/2012 | Davis et al. | 30/162 |
| 8,347,509 | B2 * | 1/2013 | Votolato | 30/156 |
| 8,353,109 | B2 * | 1/2013 | Rohrbach | 30/162 |
| 8,443,522 | B2 * | 5/2013 | Jennings et al. | 30/162 |
| 8,549,754 | B2 * | 10/2013 | Bung et al. | 30/161 |
| 8,561,305 | B2 * | 10/2013 | Davis et al. | 30/162 |
| 2003/0159290 | A1 * | 8/2003 | Berns | 30/162 |
| 2004/0237312 | A1 * | 12/2004 | Hernandez et al. | 30/162 |
| 2007/0209209 | A1 * | 9/2007 | Davis et al. | 30/162 |
| 2008/0163493 | A1 * | 7/2008 | Votolato | 30/154 |
| 2008/0189956 | A1 * | 8/2008 | Polei | 30/162 |
| 2008/0250651 | A1 * | 10/2008 | Davis et al. | 30/162 |
| 2008/0282547 | A1 * | 11/2008 | Leger et al. | 30/162 |
| 2008/0289190 | A1 * | 11/2008 | Jennings et al. | 30/155 |
| 2009/0106983 | A1 * | 4/2009 | Berns | 30/162 |
| 2009/0241345 | A1 * | 10/2009 | Huang | 30/162 |
| 2009/0260235 | A1 * | 10/2009 | Rohrbach | 30/162 |
| 2009/0271988 | A1 * | 11/2009 | Votolato | 30/158 |
| 2009/0307911 | A1 * | 12/2009 | Austin | 30/162 |
| 2010/0018061 | A1 * | 1/2010 | Votolato | 30/153 |
| 2010/0088900 | A1 * | 4/2010 | Davis et al. | 30/162 |
| 2011/0035947 | A1 * | 2/2011 | Rohrbach | 30/162 |
| 2011/0119925 | A1 * | 5/2011 | Rohrbach | 30/158 |
| 2011/0302787 | A1 * | 12/2011 | Rohrbach | 30/162 |
| 2012/0079722 | A1 * | 4/2012 | Quimby et al. | 30/165 |
| 2012/0240413 | A1 * | 9/2012 | Quimby et al. | 30/161 |
| 2012/0279071 | A1 * | 11/2012 | Garavaglia et al. | 30/162 |
| 2013/0061444 | A1 * | 3/2013 | Lutgen et al. | 30/329 |
| 2013/0061475 | A1 * | 3/2013 | Lutgen et al. | 30/151 |
| 2013/0061476 | A1 * | 3/2013 | Lutgen et al. | 30/151 |
| 2013/0061477 | A1 * | 3/2013 | Lutgen et al. | 30/158 |
| 2013/0061478 | A1 * | 3/2013 | Lutgen et al. | 30/161 |
| 2013/0061479 | A1 * | 3/2013 | Lutgen et al. | 30/329 |
| 2013/0062374 | A1 * | 3/2013 | Spoelstra et al. | 30/164 |
| 2013/0067751 | A1 * | 3/2013 | Davis et al. | 30/162 |
| 2013/0185943 | A1 * | 7/2013 | Landwehr | 30/153 |
| 2013/0239415 | A1 * | 9/2013 | Wagner | 30/162 |
| 2013/0247382 | A1 * | 9/2013 | Hongquan et al. | 30/156 |
| 2013/0333230 | A1 * | 12/2013 | Quimby et al. | 30/321 |

FOREIGN PATENT DOCUMENTS

| | | | | |
|---|---|---|---|---|
| DE | 102008007090 | B3 | * | 5/2009 |
| DE | 102012001491 | B4 | * | 9/2013 |
| EP | 1946897 | A1 | * | 7/2008 |
| EP | 1982802 | A1 | * | 10/2008 |
| EP | 1982804 | A1 | * | 10/2008 |
| EP | 2388113 | A1 | * | 11/2011 |
| EP | 2641705 | A1 | * | 9/2013 |
| FR | 2552006 | A1 | * | 3/1985 |
| FR | 2911532 | A1 | * | 7/2008 |
| FR | 2956341 | A1 | * | 8/2011 |
| WO | WO 9404324 | A1 | * | 3/1994 |
| WO | WO 9832572 | A3 | * | 9/1998 |
| WO | WO 2004106012 | A1 | * | 12/2004 |
| WO | WO 2009095002 | A1 | * | 8/2009 |
| WO | WO 2010045148 | A1 | * | 4/2010 |
| WO | WO 2013110264 | A1 | * | 8/2013 |

* cited by examiner 130
133
132

134
130

130
134
133
132

134
133
132
130

130
134
133
132

UTILITY KNIFE WITH RETRACTABLE BLADE

CROSS REFERENCES TO RELATED APPLICATIONS

This application claims the benefit of provisional patent application Ser. No. 61/517,700 filed on Apr. 25, 2011 for a "Knife 2-D", which is incorporated herein by reference.

FIELD OF THE INVENTION

This invention relates to a utility knife having a body and a blade holder which are operable for extension of the blade holder for exposing the blade and which is also operable for retracting the blade holder so that the blade is covered.

BACKGROUND

Previous retractable blade knives provide either sliding mechanisms for sliding a blade from a covered position to an exposed position. Optionally, the prior art does teach relatively complex mechanisms for pivoting a blade assembly from a retracted position to an extended position. For safety reasons, it has been position so that the blade is concealed when not in use. This is particularly advantageous when considering that such knives are often thrown into tool boxes with other tools where a knife with an exposed blade may cut the hand of a mechanic seeking another tool within the tool box. Accordingly, what is needed is a simple pivoting blade knife with a simple, reliable mechanism for pivoting a blade assembly from a refracted position, which conceals the sharp edges of the cutting blade within the body of a handle, to an extended position in which the blade is exposed for use. And, further, what is needed is such a retractable blade knife wherein the blade assembly is biased in the retracted position and only moves to the extended position for use when an operator grasps the handle of the knife for use.

SUMMARY

The above described need is addressed by a retractable blade utility knife which includes a body, a handle lever and a blade holder assembly. The body may be considered as having a proximate end and a distal end. The handle lever may also be considered as having a proximate end and a distal end. The blade holder assembly includes a holder portion and a blade that is held by the holder portion so that the blade presents at least one cutting edge. The blade holder assembly is pivotably mounted to the body near the distal end of the body so that the blade holder assembly can pivot between a retracted position in which the cutting edge is enclosed within the body of the knife and an extended position in which the cutting edge is outside the body of the knife and exposed for use. The handle lever is mounted to the body at a pivot joint located between the proximate and distal ends of both the lever member and the body so that the handle lever can pivot between an open position and a closed position. The handle lever is also preferably biased toward the open position. The handle lever has a handle lever pin mounted to its distal end. The handle lever pin is received for sliding movement by a corresponding slot in the blade holder assembly. When the handle lever is urged from the open position to the closed position, the pin pushes against the blade holder assembly as it also slides within the slot to cause the blade holder assembly to rotate from the retracted position to the extended position. When the blade holder assembly rotates to the extended position, the cutting edge of the blade emerges from inside the body and is exposed for use.

DETAILED DESCRIPTION

Figure 1:
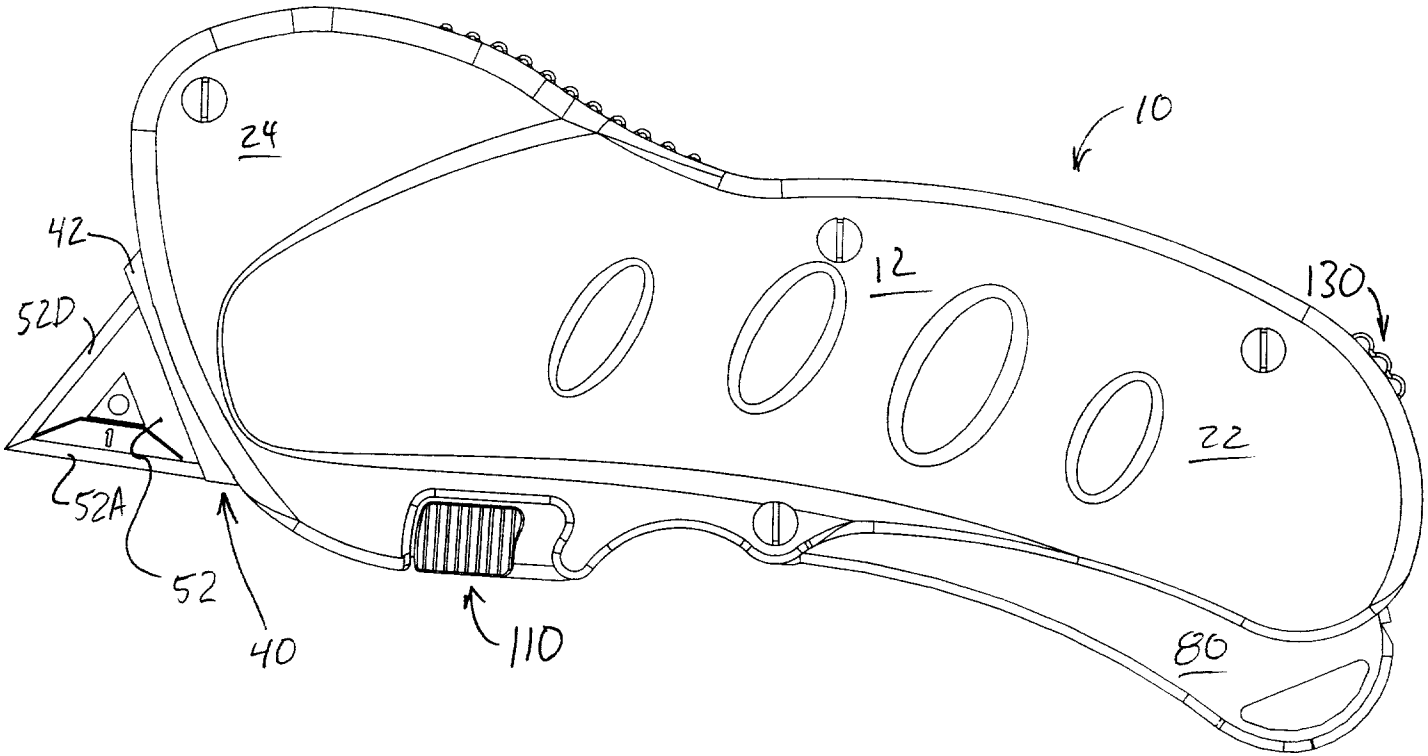
FIG. 1 is a side view of the retractable blade utility knife.
Figure 2:
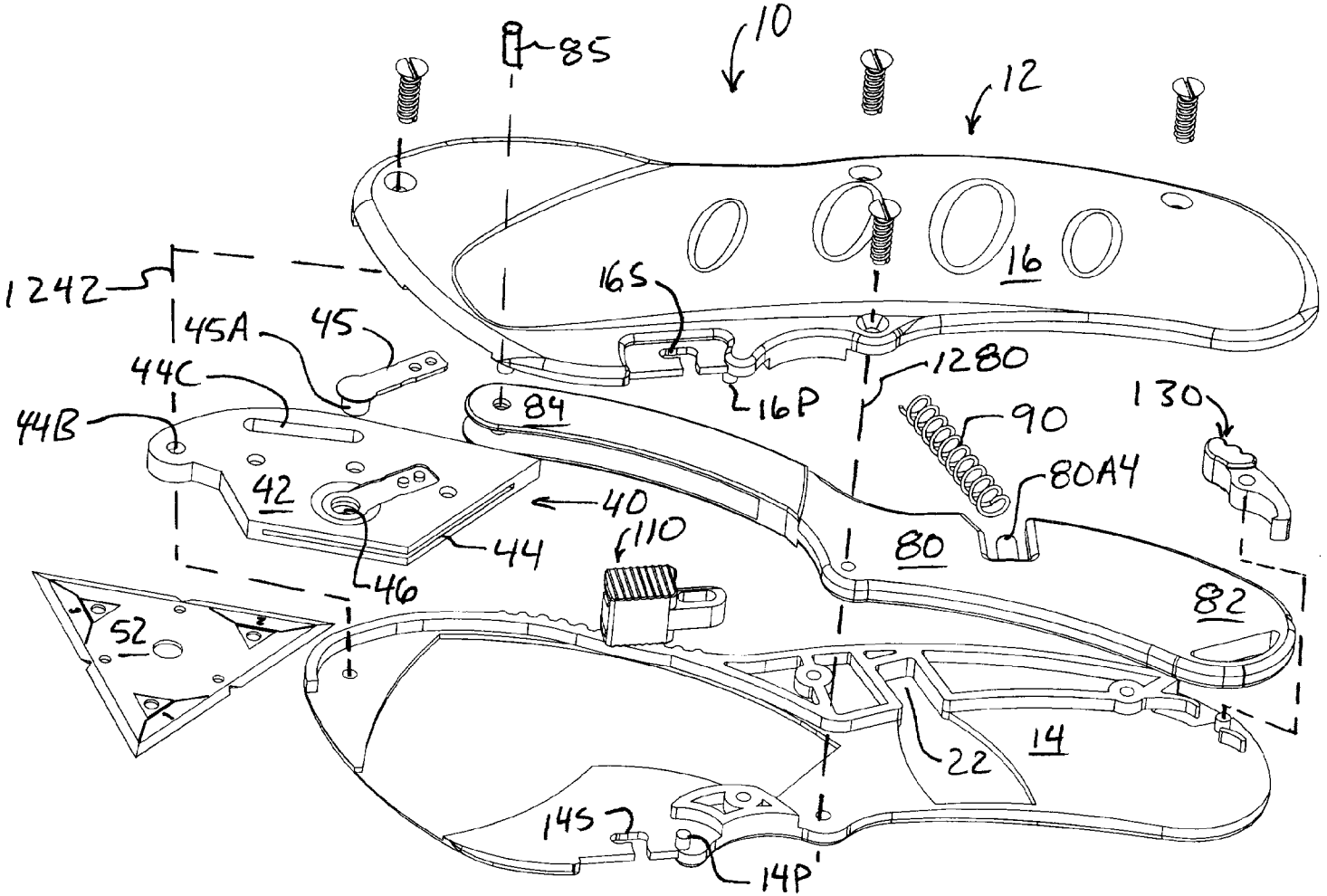
FIG. 2 is an exploded perspective view of the retractable blade utility knife.

Referring to the drawings, FIG. 1 shows a retractable blade utility knife 10 as including a body 12, a blade holder assembly 40 and a handle lever 80. FIG. 2 provides an exploded perspective view of retractable blade utility knife 10. With reference to FIGS. 1 and 2, body 12 may be considered as having a lower portion 14 and an upper portion 16. When body 12 is assembled as shown in FIG. 1, body 12 may also be considered as having a proximate end 22 and a distal end 24. Handle lever 80 may also be considered as having a proximate end 82 and a distal end 84. Blade holder assembly 40 includes a blade holder portion 42 and a blade 52 that is held by blade holder portion 42 so that blade 52 presents at least one cutting edge 52A. In this example, blade 52 has two cutting edges exposed, namely cutting edges 52A and 52D. (The locations of the other cutting edges of blade 52 will be described in greater detail below.)

Figure 8A:
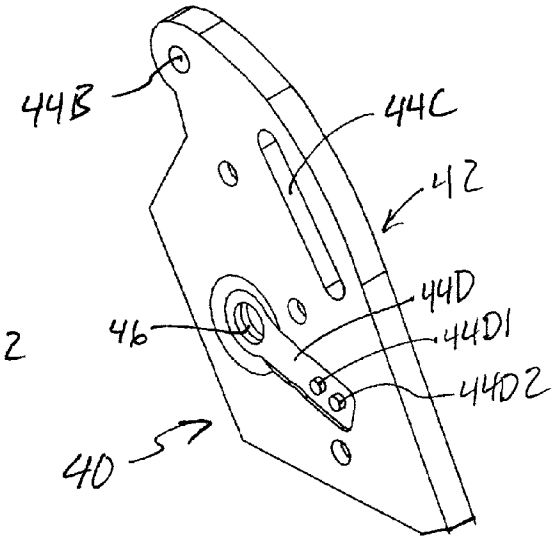
FIG. 8A is a first perspective view of a blade holder assembly shown without a blade.
Figure 8B:
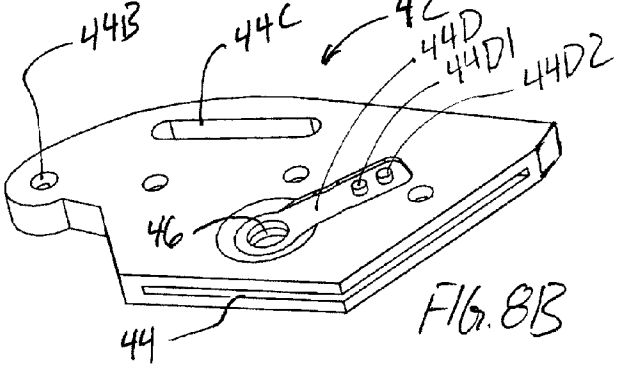
FIG. 8B is a second perspective view of a blade holder assembly shown without a blade.
Figure 8C:
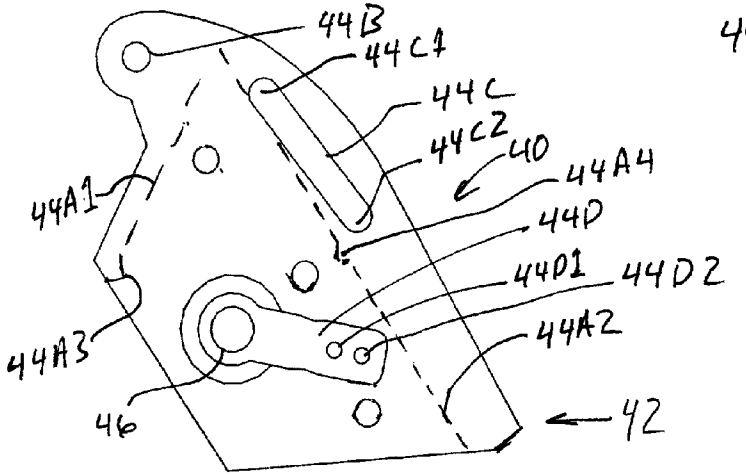
FIG. 8C is a side view of a blade holder assembly shown without a blade.
Figure 8D:
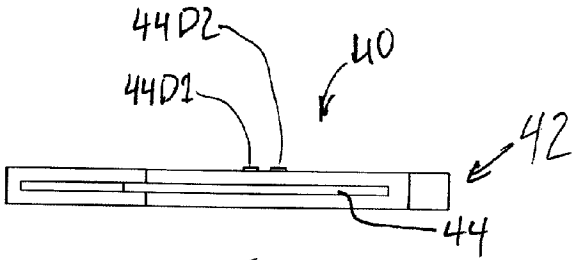
FIG. 8D is an end view of a blade holder assembly shown without a blade.
Figure 8F:
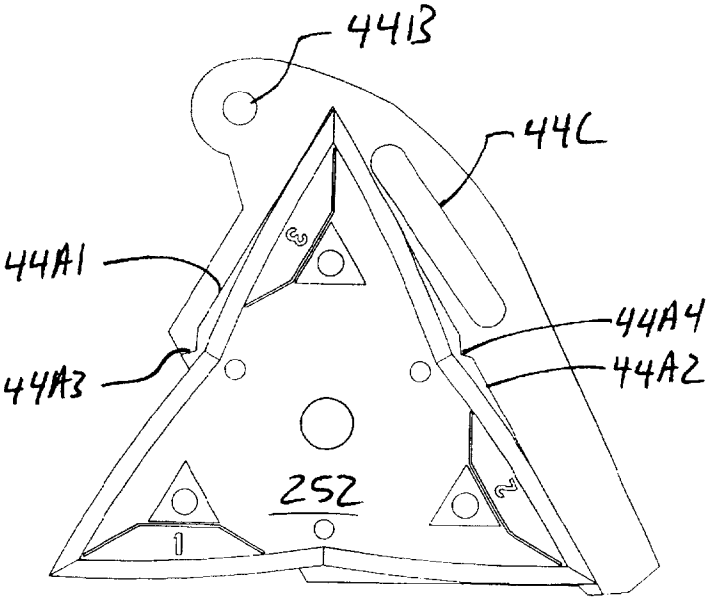
FIG. 8F is a disassembled side view of a blade holder assembly shown holding a second type of triangular blade.
Figure 8E:
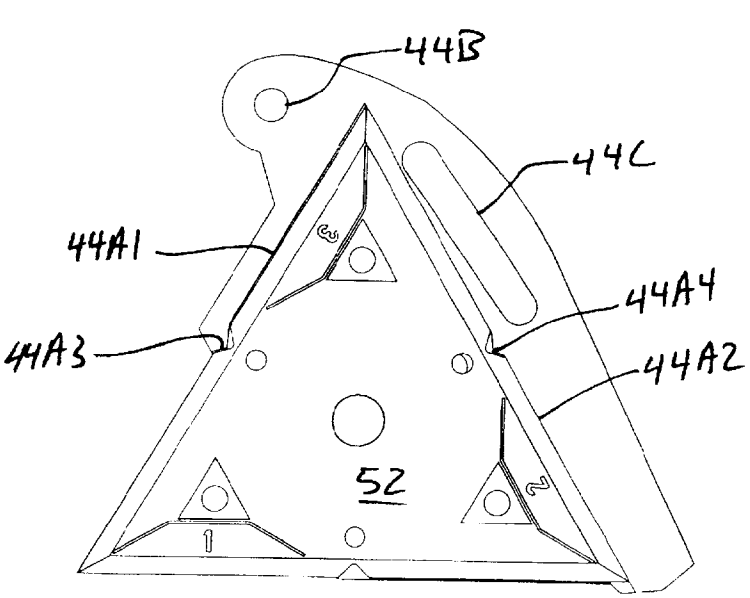
FIG. 8E is a disassembled side view of a blade holder assembly shown holding a first type of triangular blade.

With closer inspection of FIGS. 2-5 and FIGS. 8A-8D, the skilled reader is able to understand how blade holder assembly 40 receives and holds blade 52 and how blade holder assembly 40 is pivotably mounted to body 12. In FIGS. 2-6A, upper side portion 14 of body 12 is removed to expose the various parts of knife 10. The skilled reader should view FIGS. 2-6A as if upper side portion 14 of body 12 is present but perfectly transparent. As can be seen in FIGS. 8A-8D, blade holder assembly 40 includes a blade holder portion 42. Blade holder portion 42 includes a body which presents a blade slot 44. Blade slot 44 is shaped and sized for receiving a blade 52. In this example, blade 52 is a triangular blade having six sequentially numbered cutting edges (cutting edges 52A-52F numbered as 1-6 respectively) as shown in FIG. 5A. Blade slot 44 extends as indicated by the dash lines in FIG. 8C. The dashed lines in FIG. 8C indicate the internal edges 44A1 and 44A2 of blade slot 44. In FIGS. 8E and 8F, blade holder portion 42 is shown with its upper part removed in order to reveal the internal geometry of slot 44. As can be seen in FIG. 8E, in this example, internal edges 44A1 and 44A2 present two tabs 44A3 and 44A4 respectively. Tabs 44A3 and 44A4 are arranged to register with corresponding notches 52H defined in the edges of blade 52 (indicated in FIG. 5A). Tabs 44A3 and 44A4 and notches 52H are optional, however, tabs 44A3 and 44A4 and notches 52H are useful for facilitating the locating and securing of blade 52. In FIG. 8F, an optional triangular blade 252 has edges which present gradual indentations which also register with tabs 44A3 and 44A4.

Blade holder portion 42 also presents a bore 44B that is situated in an upper corner of blade holder portion 42. As can be seen in FIG. 2, bore 44B receives a fastener common to body 12 which is located at the distal end of body 12. This combination provides a pivot joint for pivoting blade holder portion 42 for rotation about an axis 1242 between a retracted position shown in FIG. 3, an extended cutting position shown in FIG. 4 and a blade changing position shown in FIG. 5.

In this example, aligned holes including a bore 52G at the center of blade 52 and at least one corresponding hole 46 in blade holder portion 42 register with and receive a pin portion 45A of a retention tab 45 that is mounted to blade holder portion 42. When pin portion 45A is received by the aligned holes, blade 52 is secured within blade holder portion 42. Flexible blade retention tab 45 is shown in detail in FIGS. 10A-10D and will be described in greater detail below. In this example, as shown in FIGS. 8A-8D blade holder portion 42 includes a tab recess 44D having two bosses 44D1 and 44D2 which are received by corresponding holes 45B1 and 45B2 presented by a flexible retention tab 45.

Flexible blade retention tab 45 is shown in detail in FIGS. 10A-10D. As can be seen in FIG. 10A-10D, flexible retention tab 45 includes a tab body 45B from which extends a tab pin 45A. Tab body 45B also presents two holes 45B1 and 45B2 which are spaced and located to register with bosses 44D1 and 44D2 of blade holder portion 42 respectively. As noted above, bosses 44D1 and 44D2 project from the floor of tab recess 44D of blade holder portion 42. In this example, blade retention tab 45 may be secured to blade holder portion 42 either by an adhesive, by fusing with heat or additionally or alternatively by interference fits between bosses 44D1 and 44D2 of blade holder portion 42 and holes 45B1 and 45B2. Tab body 45B is flexible so that tab pin 45A may be moved by flexing tab body 45B between two positions: (1) a first position (shown in FIG. 5) in which tab pin 45A is received by central hole 46 of blade holder portion 42 and central hole 52G of blade 52 thereby securing blade 52 to blade holder portion 42, and, (2) a second position (shown in FIG. 5A) in which tab pin 45A is at least disengaged from central hole 52G of blade 52 thereby making it possible to remove blade 52 from blade holder portion 42.

Blade holder portion 42 also presents an elongated slot 44C which is located adjacent to and oriented generally parallel to internal edge 44A2 of blade slot 44. As can be best understood by referring to FIG. 2, slot 44C is operable for slidably receiving a handle lever pin 85 which is common to the distal end 84 of handle lever 80. The interaction between slot 44C and handle lever 80 will be described in greater detail below.

Figure 7A:
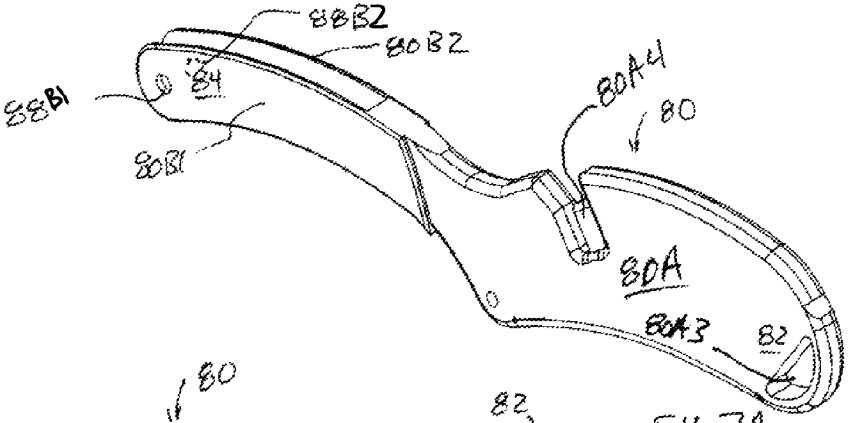
FIG. 7A is a perspective view of a handle lever.
Figure 7C:
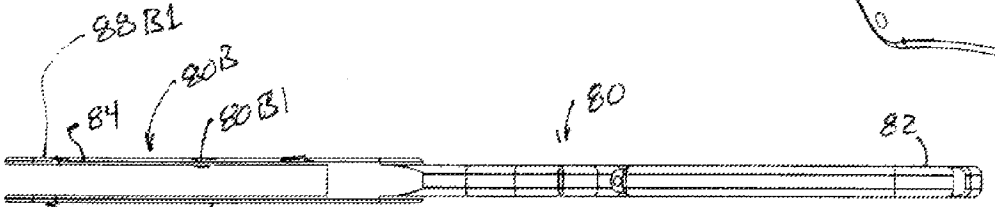
FIG. 7C is a top view of a handle lever.
Figure 7B:
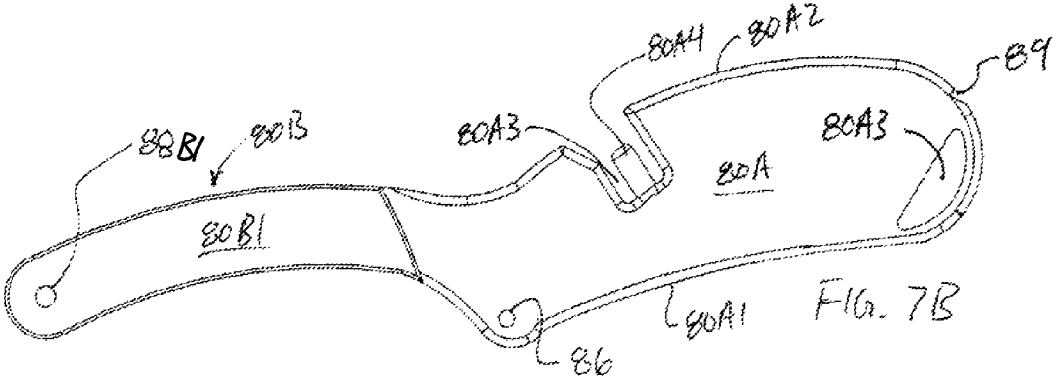
FIG. 7B is a side view of a handle lever.

Handle lever 80 is also mounted to body 12 to rotate between various positions as will be described in greater detail below. As can be best understood by referring to FIGS. 7A-7C, handle lever 80 has a proximate end 82 and a distal end 84. Further, in this example, handle lever 80 may be understood has having a solid handle portion 80A and a clevis portion 80B which presents two opposing tangs 80B1 and 80B2. Handle portion 80A has a slightly curved external edge 80A1 and an opposite internal edge 80A2. External edge 80A1 is curved for receiving the fingers of a human hand. Edge 80A1 may optionally include a series of four indentations (not shown) for receiving fingers. Internal edge 80A2 presents a recess 80A3 which shelters a boss 80A4. Boss 80A4 is adapted to receive a compression spring as will be described in greater detail below. Handle lever 80 presents two holes for receiving pins or fasteners. Located in handle portion 80A between proximate end 82 and distal end 84 is a fastener hole 86. As can be seen in FIGS. 2-5, fastener hole 86 receives a fastener common to body 12. In this example, this fastener is one of the fasteners that fastens together side portions 14 and 16 of body 12. A pair of aligned holes 88B1 and 88B2 disposed in tangs 80B1 and 80B2 respectively are located at the distal end of handle lever 82. Holes 88B1 and 88B2 receive a handle lever pin 85 shown in FIG. 2. Handle lever pin 85 is also received by slot 44C of blade holder assembly 40 as will be described in greater detail below. At the extreme proximal end of handle lever 80 is an opening 80A3 which has been added to facilitate the hanging of knife 10 from a hook or the like for easy storage of knife 10.

Figure 3:
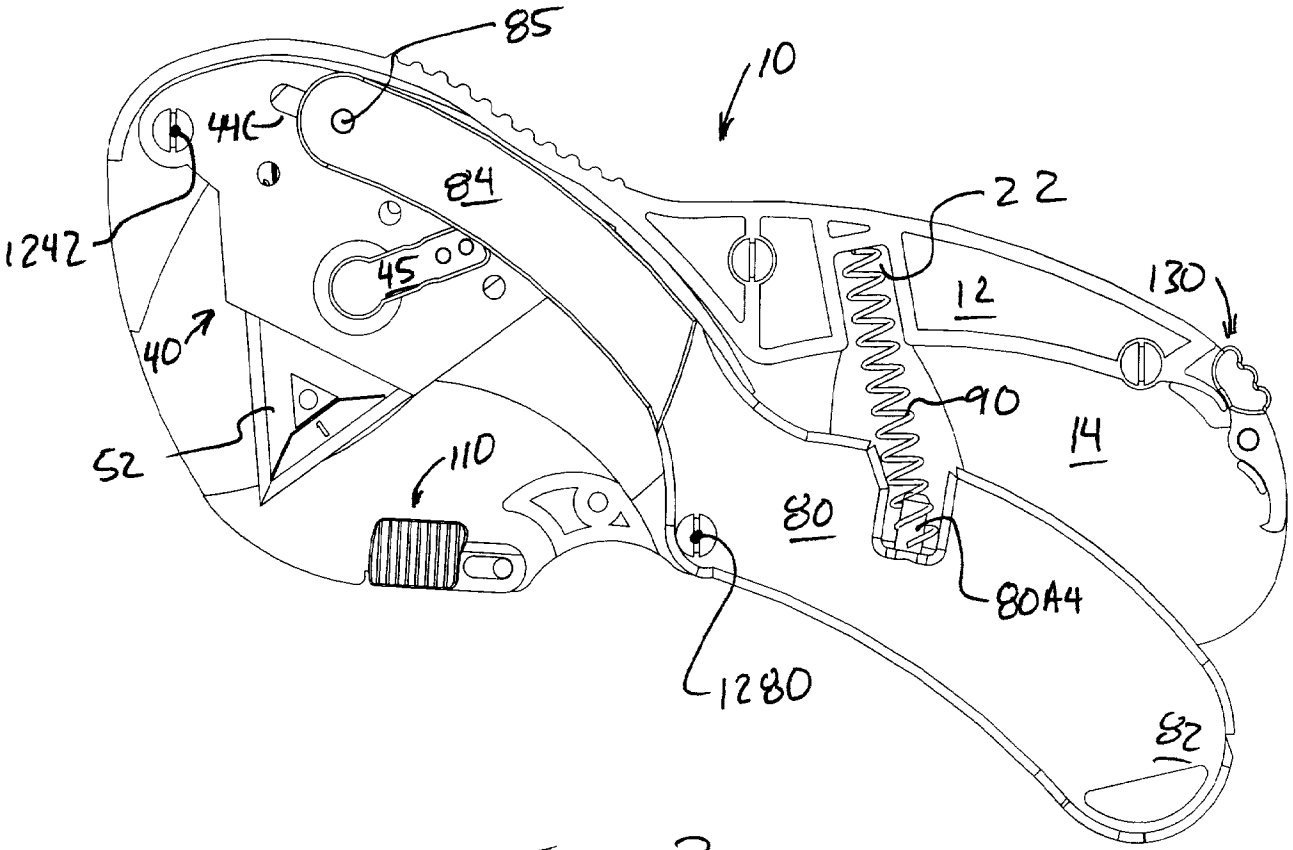
FIG. 3 is a disassembled side view of the retractable blade utility knife shown with the upper panel of the body removed to show the interior of the knife and so that the knife is shown with the blade holder assembly in the retracted position and the handle lever in the open position.

As can be seen in FIGS. 2-5, with particular reference to FIG. 3, handle lever 80 is mounted to body 12 at a first pivot joint 1280. Similarly, blade holder assembly 40, and more particularly, blade holder portion 42 is mounted to body 12 at a second pivot joint 1242. As noted above, blade holder assembly 40 pivots between a first retracted position shown in FIG. 3, a second extended position shown in FIG. 4 and a third blade replacing position shown in FIGS. 5 and 5A. Similarly, handle lever 80 is pivotably mounted to body 12 at pivot joint 1280 between an open position shown in FIG. 3, a first closed position shown in FIG. 4 and a second closed position shown in FIGS. 5 and 5A. As can be seen in FIGS. 3-5A, pivot joint 1280 is located between the proximal and distal ends of body 12, and handle member 80 mounts to it at a location that is between the proximal and distal ends of handle member 80. By means of a mechanical relationship which will be described in greater detail below, when handle lever 80 is in the open position shown in FIG. 3, blade holder assembly 40 is in the retracted position shown in FIG. 3 so that blade 52 is retracted within body 12. Further, when handle lever 80 is in the first closed position shown in FIG. 4, blade holder assembly 40 is in the extended position shown in FIG. 4 such that blade 52 is exposed for use. Further, when handle lever 80 is rotated to the second closed position shown in FIG. 5, blade holder assembly 40 is rotated away from body 12 sufficiently to allow access to flexible tab 45 so that blade 52 may be removed as shown in FIG. 5A.

Figure 4:
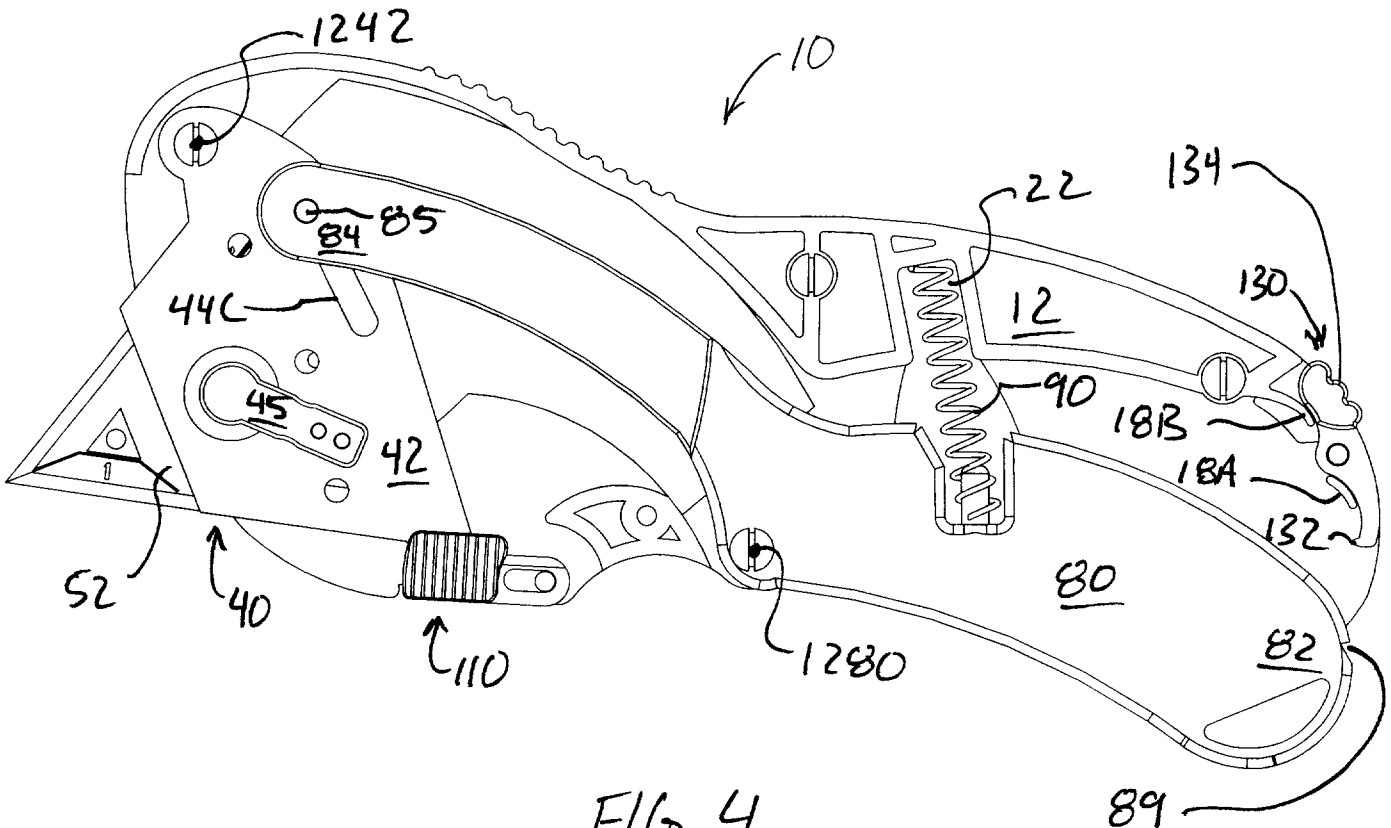
FIG. 4 is a disassembled side view of the retractable blade utility knife shown with the upper panel of the body removed to show the interior of the knife and so that the knife is shown with the blade holder assembly in the extended position and the handle lever in a first closed position.
Figure 5:
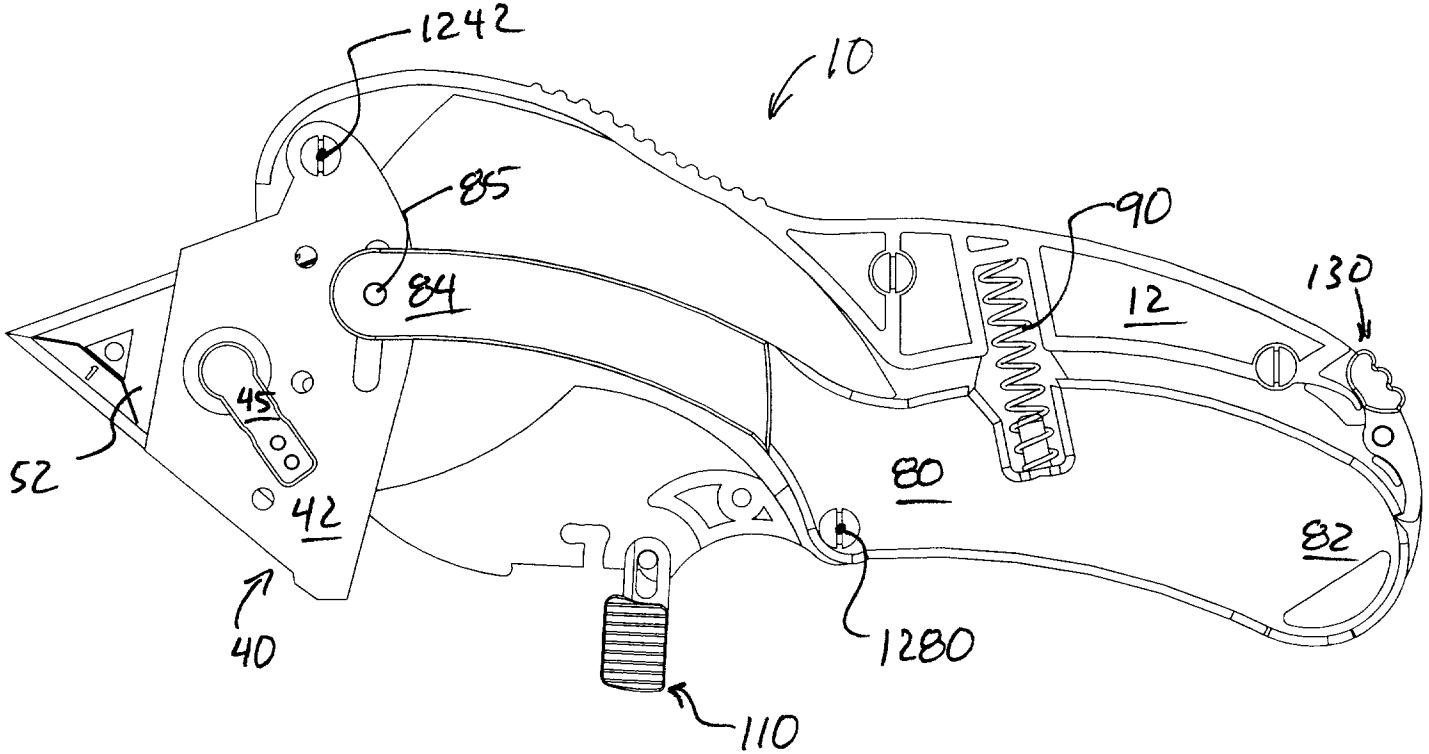
FIG. 5 is a disassembled side view of the retractable blade utility knife shown with the upper panel of the body removed to show the interior of the knife and so that the knife is shown with the blade holder assembly further extended in a blade changing position and the handle lever further closed in a second closed position.
Figure 5A:
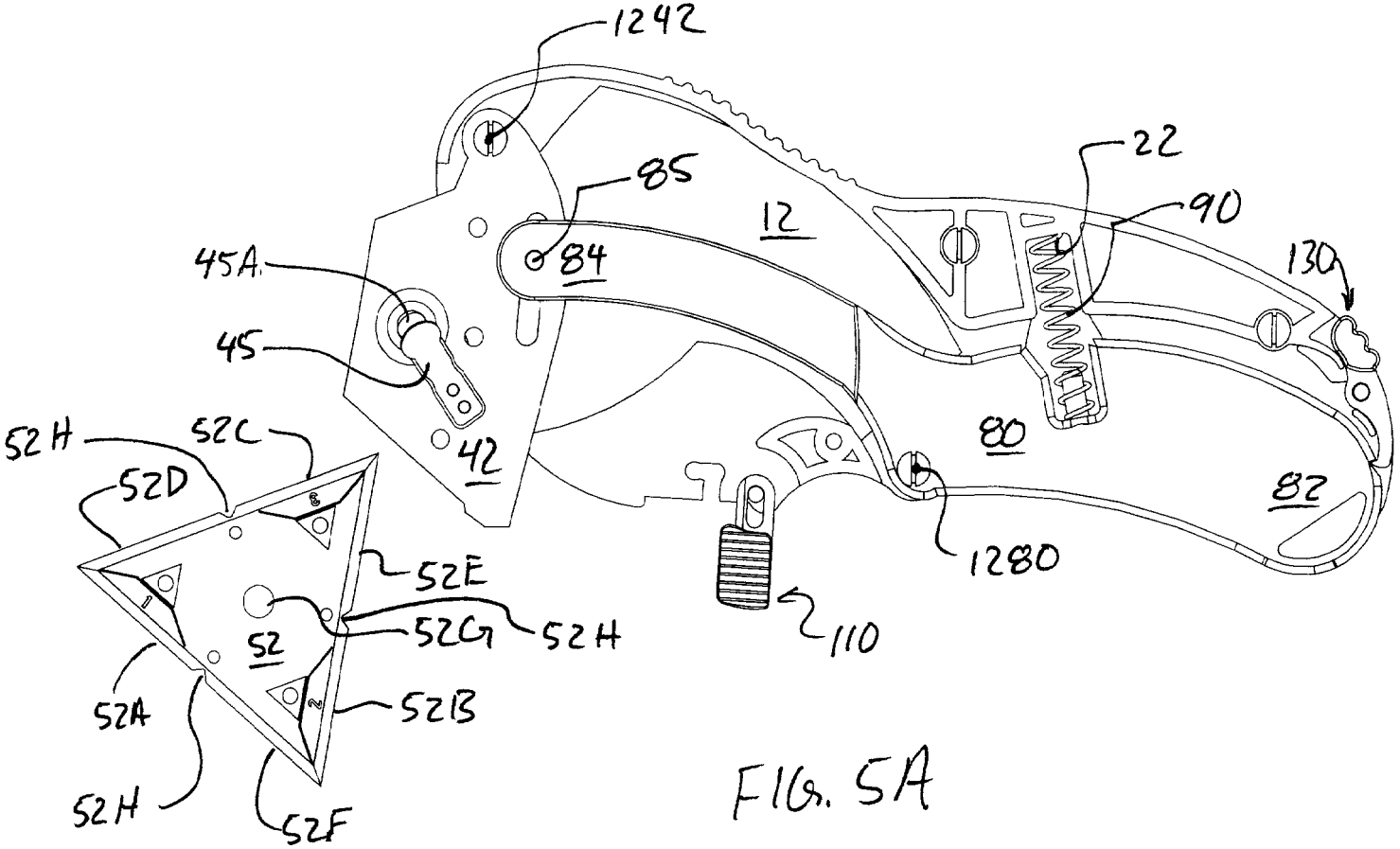
FIG. 5A is a disassembled side view as in FIG. 5 shown with the blade removed from the blade holder assembly.

In this example, a compression spring 90 extends between boss 80A4 of handle lever 80 and a recess 22 defined in body 12 as shown in FIGS. 2-5A. Compression spring 90 biases handle lever 80 away from body 12 toward the open handle lever position shown in FIG. 3. This position corresponds to a position in which blade assembly 40 is completely retracted. When handle lever 80 is squeezed toward the first closed position shown in FIG. 4, handle lever 80 stops as blade holder portion 42 of blade assembly 40 encounters a blade lock tab 110. In this example, a blade lock tab 110, such as is illustrated in FIGS. 9A-9E, is used to provide a stop for arresting the motion of blade holder assembly 40 in a position appropriate for using blade 52 as shown in FIG. 4. When blade lock tab 110 is moved to a released position as shown in FIG. 5, then blade holder assembly may be further rotated away from body 12 to the blade changing position shown in FIG. 5.

Figures 9A, 9B, 9C, 9D, 9E:
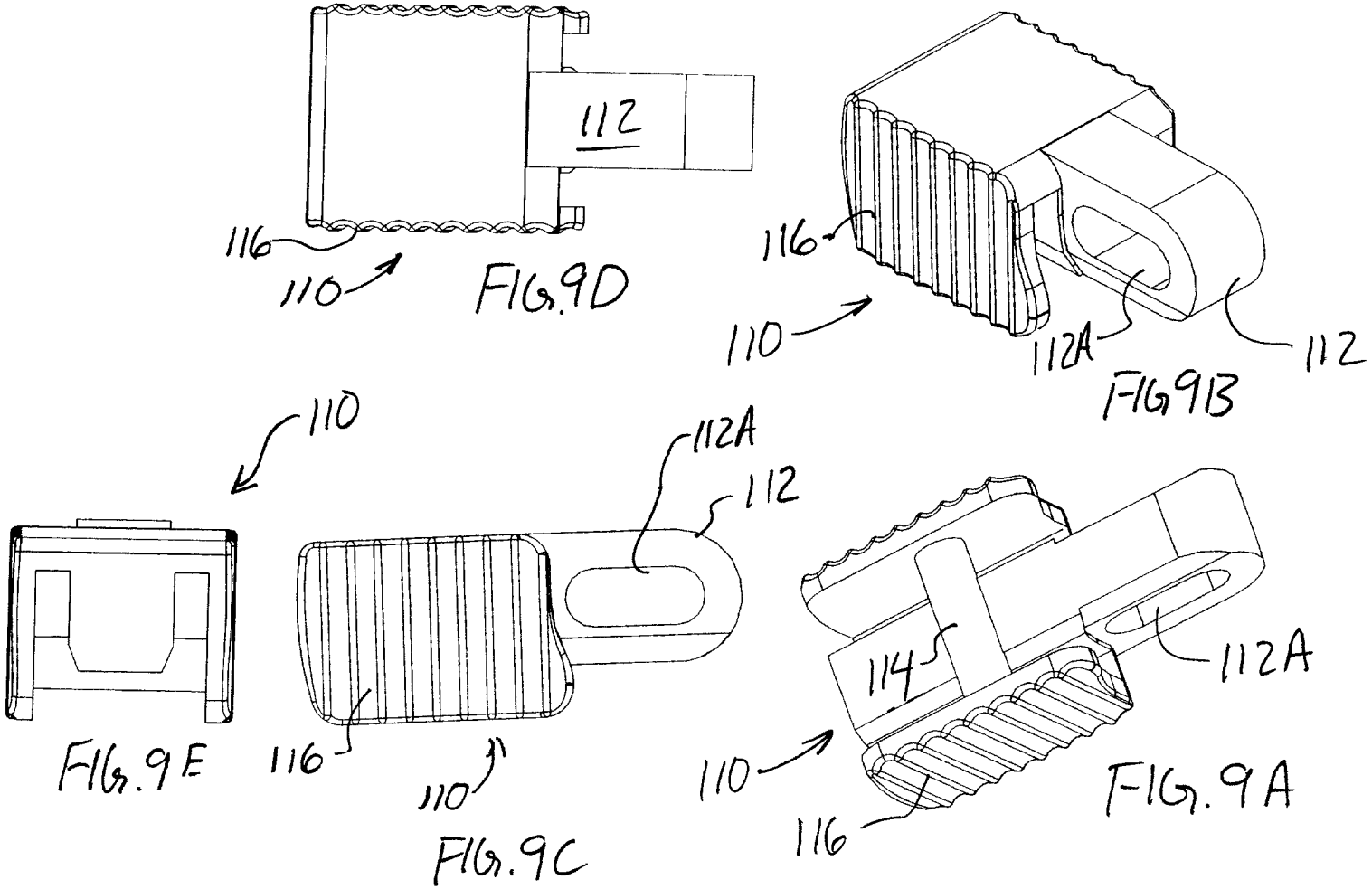
FIG. 9A is a first perspective view of a blade stop.
FIG. 9B is a second perspective view of a blade stop.
FIG. 9C is a side view of a blade stop.
FIG. 9D is a bottom view of a blade stop.
FIG. 9E is an end view of a blade stop.
Figure 10A:
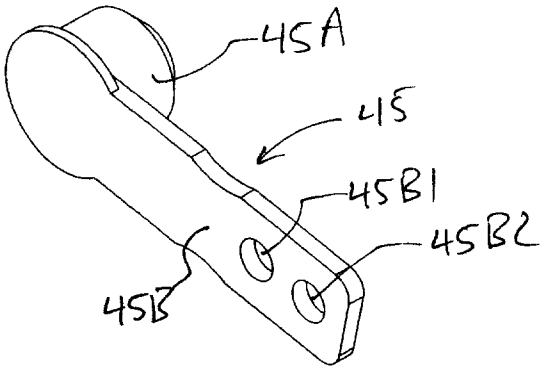
FIG. 10A is a first perspective view of a blade lock for a blade holder assembly.
Figure 10B:
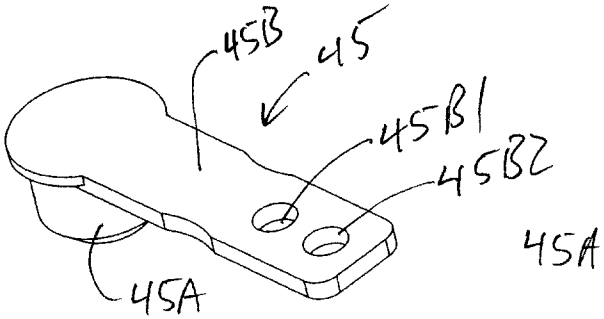
FIG. 10B is a second perspective view of a blade lock for a blade holder assembly.
Figure 10C:
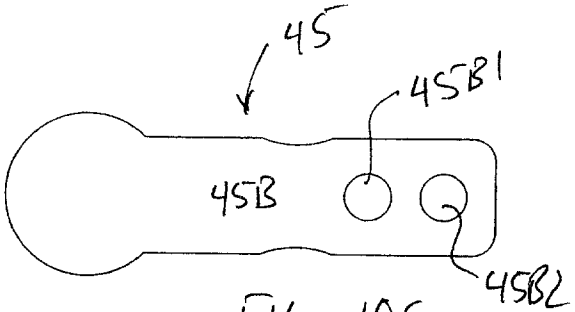
FIG. 10C is a side view of a blade lock for a blade holder assembly.
Figure 10D:
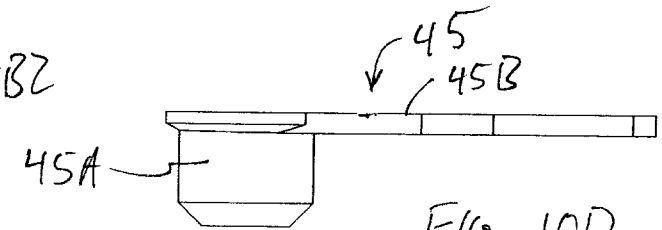
FIG. 10D is an end view of a blade lock for a blade holder assembly.
Figures 11A, 11B, 11C, 11D, 11E:
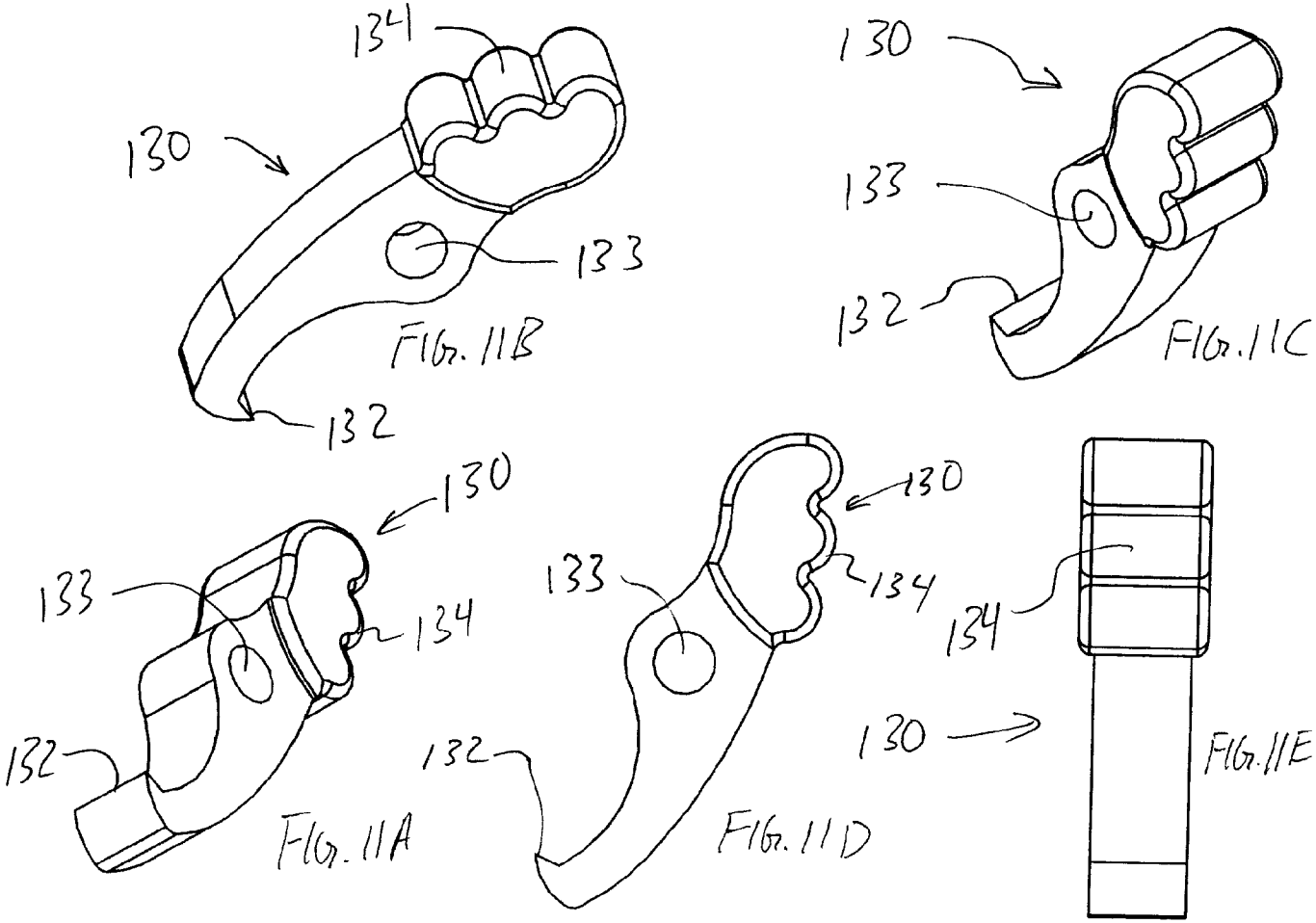
FIG. 11A is a first perspective view of a handle lock.
FIG. 11B is a second perspective view of a handle lock.
FIG. 11C is a third perspective view of a handle lock.
FIG. 11D is a side view of a handle lock.
FIG. 11E is an end view of a handle lock.

Details of blade lock tab 110 may be seen in FIGS. 9A-9E. As can be seen in FIG. 9A, blade lock tab 110 includes opposing thumb pads 116 which carry a transverse pin 114. Extending from the main portion of tab 110 is a member 112 that presents a slot 112A. Slot 112A is arranged to receive opposing cylindrical bosses 14P and 16P that extend from the upper and lower portions 14 and 16 of body 12 as shown in FIG. 2. When body 12 is assembled, cylindrical bosses 14P and 16P define a pin that extends between the opposing walls of body 12. Pin 114 of blade lock tab 110 is arranged to be received by matching recessed slots 14S and 16S also defined in the upper and lower portions 14 and 16 of body 12 shown in FIG. 2. When blade lock tab 110 is in the locked position shown in FIGS. 3 and 4, pin 114 is all the way forward in slots 14S and 16S. When in this position, the upper forward surface of blade lock tab 110 interferes with the lower end of blade holder portion 42 that is opposite the exposed portion of blade 52. This prevents blade holder portion from rotating past the extended position shown in FIG. 4. When blade lock tab is released, as shown in FIG. 5, pin 114 is disengaged from slots 14S and 16S and is hanging from its own slot 112A from the pin formed by bosses 14P and 16P. This position allows rotation of blade holder portion 42 past the position shown in FIG. 4 to the blade changing position shown in FIG. 5. A user may manually manipulate blade lock tab 110 between the two positions described above.

In this example, an optional means is provided for securing handle lever 80 when handle lever 80 is in the second closed position. A latch member 130 is pivotably mounted to the proximal end of body 12. Latch member 130 presents a prong 132 which registers with a notch 89 defined in the proximal end of handle lever 80. Latch member 130 is retained in its position as shown in FIG. 4 by a tab 18A which is common to body 12 and a flexible tab 18B which is also common to body 12. When handle lever 80 is rotated to the second closed position shown in FIG. 5, the end of prong 132 encounters the curved proximal end surface of handle lever 80 and rotates counter-clockwise as flexible tab 18B flexes. When prong 132 falls into notch 89, flexible tab 18B urges latch member 130 back to the position shown in FIG. 5. If an operator applies manual inward pressure to a finger pad 134 of latch member 130, prong 132 will disengage from notch 89 thereby releasing handle lever 80 for rotation away from the second closed position. A hole 133 passes through prong 132.

As noted above, handle lever pin 85 carried at the distal end of handle lever 80 is received by slot 44C in blade holder portion 42. As can be seen by inspecting FIGS. 2-5, the location, orientation and the length of slot 44C as well as its disposition relative to bore 44B is important to the mechanical function of retractable blade utility knife 10. As can be seen in FIG. 8C, slot 44C extends between proximate end 44C1 which is relatively close to bore 44B and pivot joint 1242 shown in FIG. 2 and a distal end 44C2 which is spaced farther away from bore 44B. As can be seen in FIG. 3, when handle lever 80 is in the open position, and blade assembly 40 is in the retracted position, pin 85 engages slot 44C at a location that is spaced away from proximate end 44C1. However, as pin 85 is translated from its initial position to the first closed handle position and the blade assembly extended position shown in FIG. 4, pin 85 moves closer to pivot joint 1242 and therefore slides in slot 44C toward the proximal end 44C1 of slot 44C. As can be seen in FIG. 5, when pin 85 is translated even farther from its initial position shown in FIG. 3 to the second closed handle position and the blade replacement position shown in FIG. 5, pin 85 has receded away from pivot joint 1242 and therefore has slid in slot 44C to a position that is displaced from proximal end 44C1 of slot 44C. Thus, the interaction between slot 44C and pin 85 carried at the distal end of handle lever 80 makes it possible to rotate blade assembly 40 between the positions shown in FIGS. 3-5A by pivoting handle lever 80 as shown in those same figures.

Figure 6:
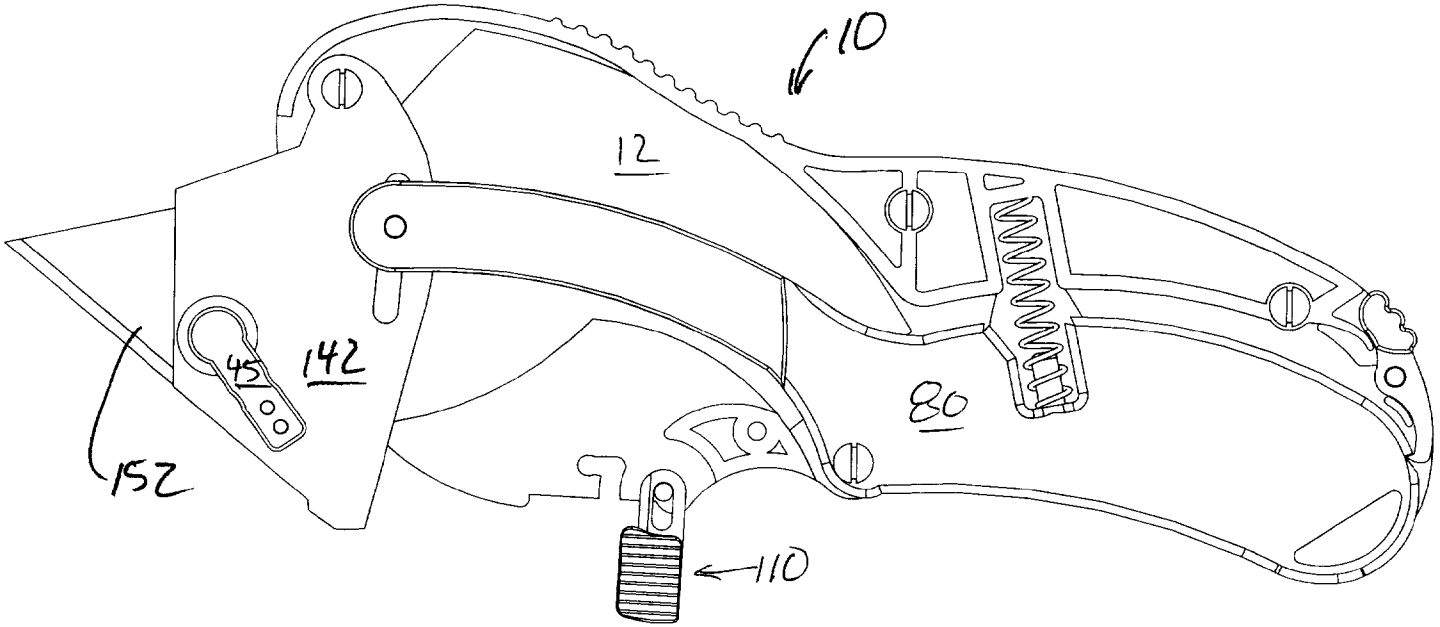
FIG. 6 is a disassembled side view as in FIG. 5 except shown with a blade holder assembly adapted for holding a standard box cutter blade.
Figure 6A:
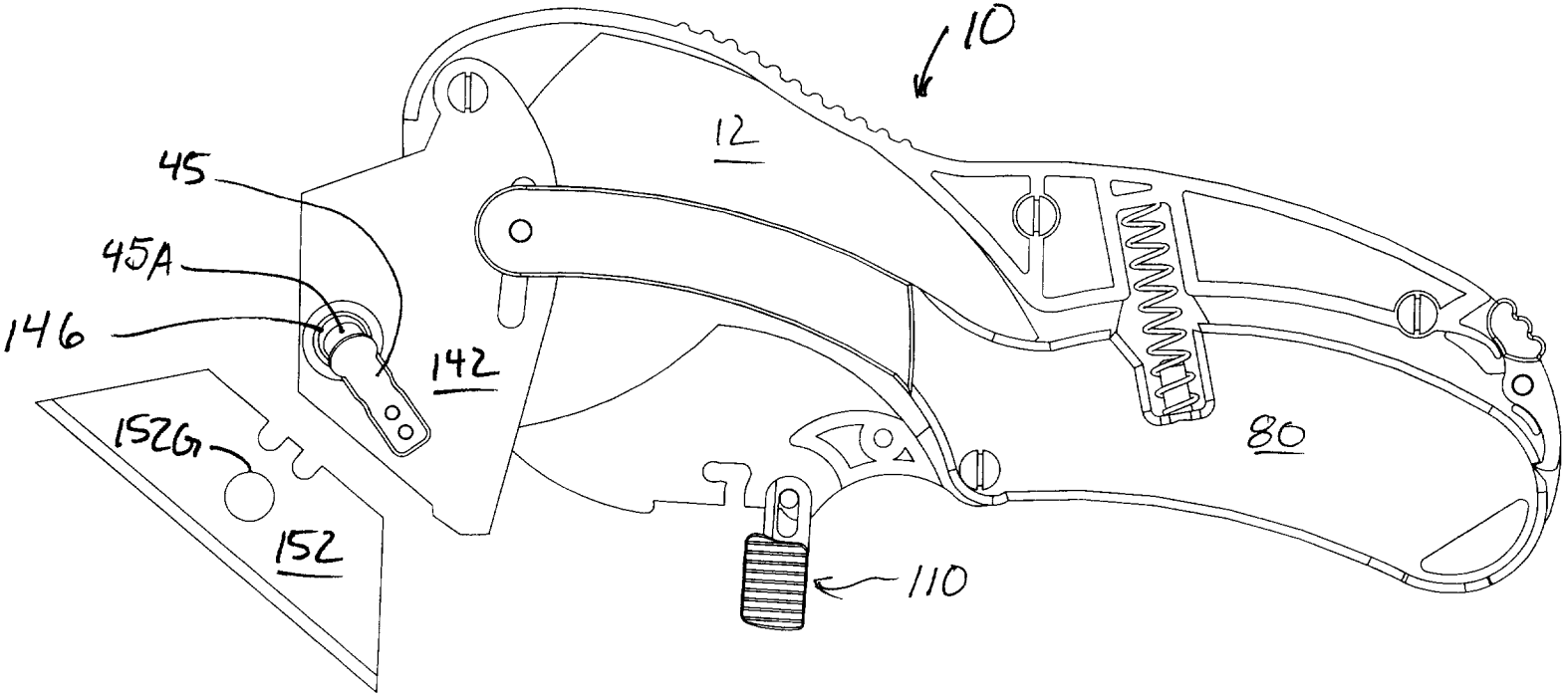
FIG. 6A is a disassembled side view as in FIG. 6 shown with the second type of blade removed from the blade holder assembly.
Figure 6B:
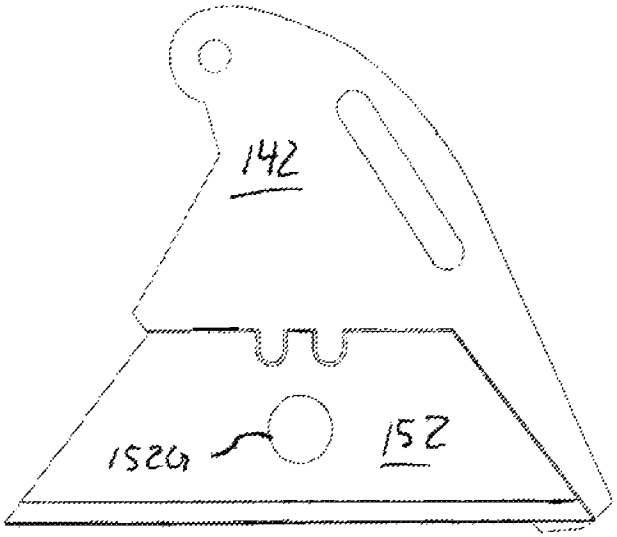
FIG. 6B is a disassembled side view of the blade holder assembly from FIG. 6 exposing the standard box cutter blade.

As can be seen in FIGS. 6 and 6A, an optional blade holder portion 142 may be fashioned to receive a blade 152 which would be interchangeable with a standard box cutter blade if used in a standard box cutter. Blade 152 is a standard box cutter blade. At least some standard box cutter blades present a hole 152G which can be used to register with a pin portion 45A of a retention tab 45. Thus by using blade holder portion 142, it is possible to adapt retractable blade knife 10 to use standard box cutter blades. Blade holder portion 142 has been renumbered in FIGS. 6 and 6A to reflect its change in configuration. The skilled reader should appreciate that hole 146 is similar to hole 46 of blade holder portion 42 but located closer to the lower edge of blade holder portion 142 so that it can register with hole 152G of standard box cutter blade 152. Retention tab 45 is not renumbered in FIGS. 6 and 6A, because, in this example, retention tab 45 shown in FIGS. 6 and 6A may be identical to retention tab 45 shown in FIGS. 2-5A.

Figure 12:
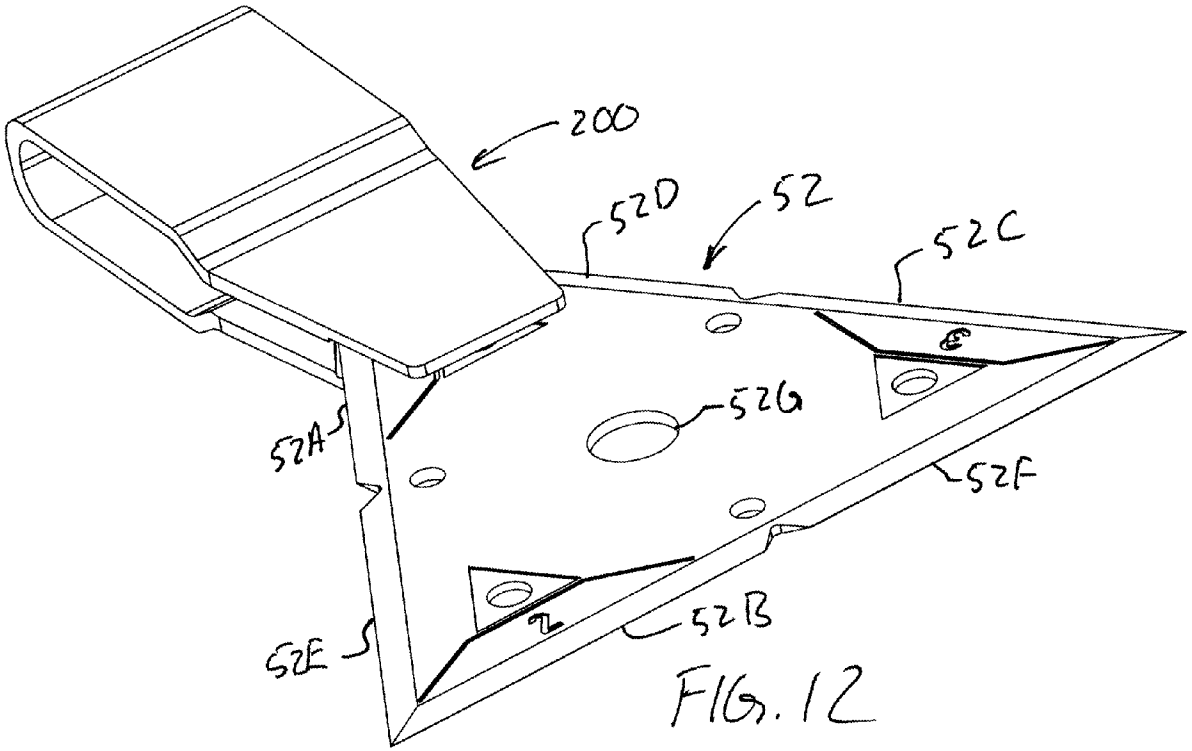
FIG. 12 illustrates tweezers adapted for pulling and handling a triangular blade.

FIG. 12 illustrates an optional tweezers 200 that had opposing prongs that present bosses which are adapted to register with holes in the periphery of triangular blade 52. These tweezers 200 are adapted to extract blade 52 without the user having to grasp material adjacent to one of the sharp cutting edges of blade 52.

Figure 13A:
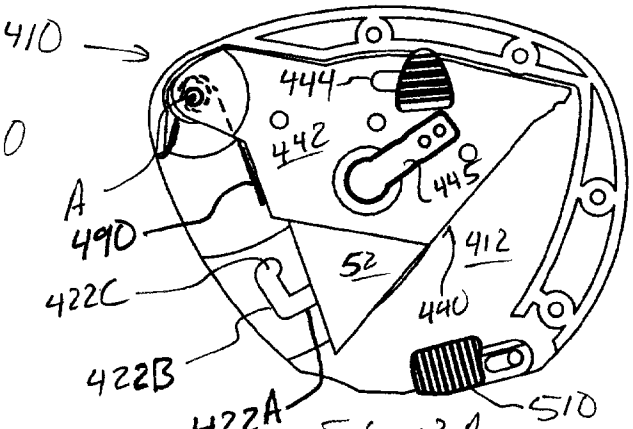
FIG. 13A is a disassembled side view of the second embodiment blade holder shown with the blade holder assembly in the retracted position.
Figure 13:
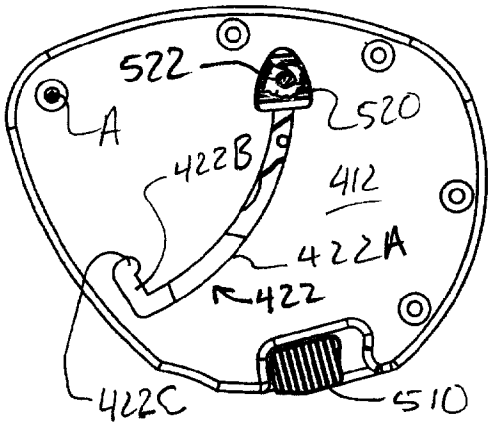
FIG. 13 is a side view of a second embodiment blade holder shown with a blade holder assembly in a refracted position.
Figure 14A:
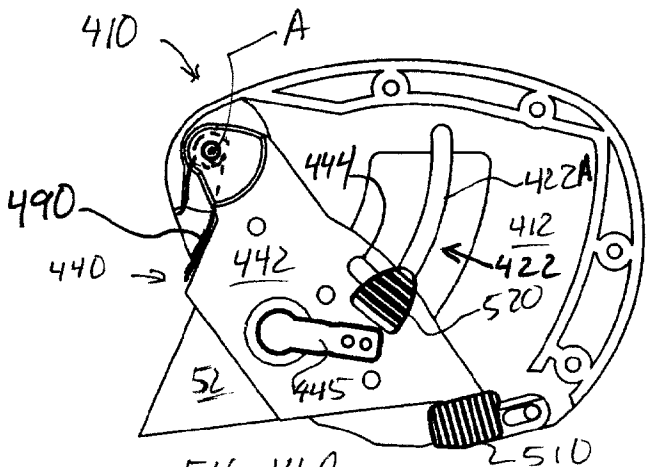
FIG. 14A is a disassembled side view of the second embodiment blade holder shown with the blade holder assembly in the extended position for using the blade.
Figure 14:
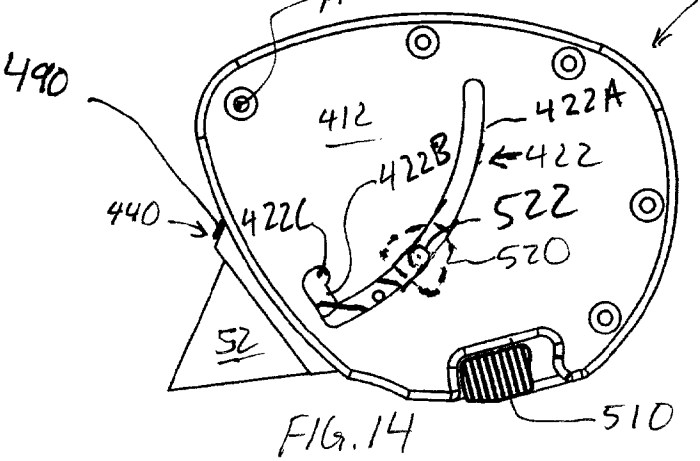
FIG. 14 is a side view of the second embodiment blade holder shown with the blade holder assembly in an extended position for using the blade.
Figure 15:
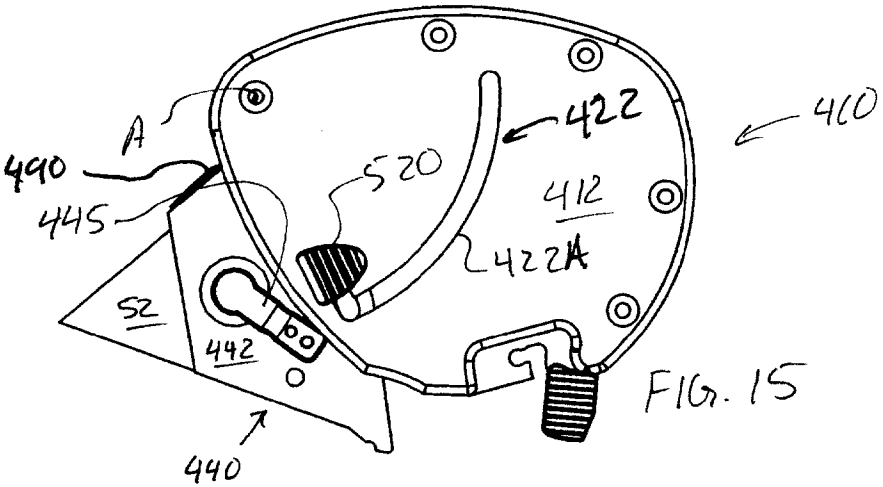
FIG. 15 is a side view of the second embodiment blade holder shown with the blade holder assembly in a second extended position for changing the blade.
Figure 15A:
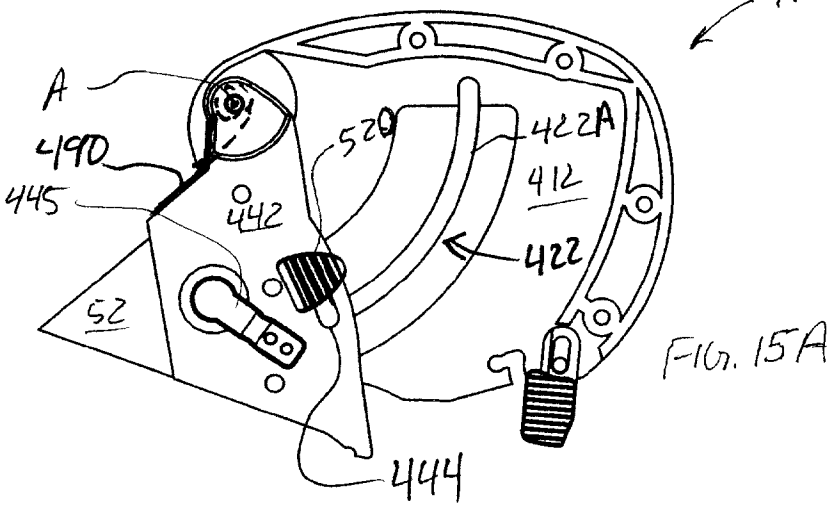
FIG. 15A is a disassembled side view of the second embodiment blade holder shown with the blade holder assembly in the second extended position for changing the blade.
Figure 15B:
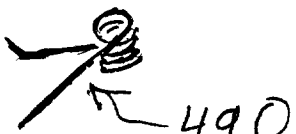
FIG. 15B is a detailed view of a spring used to bias the blade holder

FIGS. 13-15B illustrate a second embodiment retractable blade knife 410. As can be seen in FIG. 13, knife 410 includes a body 412 and a blade holder assembly 440 for carrying a triangular blade 52. As can be seen in FIGS. 13A and 14A, blade holder assembly 440 includes a blade holder portion 442. Blade holder portion 442 is generally similar to blade holder portion 42 described above. However, as will be described below, slot 444 of blade holder portion 442 is located and sized differently from slot 44C of blade holder portion 42. Blade holder portion 442 is pivotably mounted for rotation around axis A between a retracted position shown in FIG. 13A in which blade 52 is retracted within body 412 and an extended position shown in FIG. 14A in which blade 52 is exposed for use. Blade holder portion 442 also carries a flexible blade retention tab 445 which may be identical to flexible retention tab 45 of blade holder portion 45 described above. Blade holder portion 442 also presents a slot 444 which is generally parallel to its upper end as can be best understood by referring to FIGS. 13A and 15A. Slot 444 is similar to slot 44C of blade holder portion 42 but shorter in length and located in a slightly different relative location with respect to the pivot axis of blade holder portion 442. A thumb tab 520 carries a pin 522 which is adapted to be received both by slot 444 of blade holder portion 442 and a pair of matched arc shaped slots 422 in body 412 which will be described in greater detail below. Thumb tab 520 may be pushed by the users thumb in order to urge blade holder portion 442 from the retracted position shown in FIG. 13A, to the extended position shown in FIG. 14A and even to the blade changing position shown in FIG. 15A when blade lock 510 is disengaged as shown in FIGS. 15 and 15A. As is best understood with reference to FIG. 13A, in this example, blade holder portion 442 is biased by spring 490 (shown in detail in FIG. 15B) toward the retracted position shown in FIG. 13A. Spring 490 is a spiral type spring with extending legs. One leg of spring 490 rests against an internal edge of body 412 and the opposing leg pushes against an edge blade holder portion 442. The coils of spring 490 are disposed around the fastener or pin that is common to axis A. Thus, blade holder portion 442 is biased in a counter-clockwise direction as viewed from the perspective of FIGS. 13-15A.

As can be best seen in FIGS. 14 and 14A, body 412 includes a pair of matched slots 422 which are defined in the opposing side panels of body 412. Slot 422 can be best understood by referring to FIG. 14. Slot 422 includes an arc-shaped portion 422A which is disposed around axis A. At the lower end of arc-shaped portion 422A is a return channel 422B. Finally, at the end of return channel 422C is a recess 422C. As can be best understood with reference to FIGS. 13A, 14A and 15A, a user can push thumb tab 520 in a downward direction to urge blade holder portion 442 generally clockwise so that blade holder portion rotates with respect to axis A against spring 490 from the retracted position shown in FIG. 13A to the extended position shown in FIG. 14A. When in the extended position, blade holder portion 442 is constrained from further rotation by blade lock 510 which is shown engaged in FIG. 14A. Thus, the user can continue to apply thumb pressure to thumb tab 520 as he or she uses exposed blade 52 and blade holder portion 442 pushes against blade lock 510. When blade lock 510 is released as shown in FIGS. 15 and 15A, tab 520 may be urged so that tab pin 522 (shown in FIG. 14) may leave arc shaped portion 422A and follow return channel 422B. As this occurs, pin 522 also translates in slot 444 of blade holder portion 442. As is best shown in FIG. 14A, slot 444 is oriented generally normal to the arc shaped portions 422A of slots 422 of body 412 and therefore aligns with return channel 422B thereby allowing pin 522 to move down return channel 422B. After pin 522 has reached the end of return channel 422B, pressure from spring 490 can urge pin 522 into recess 422C. This causes blade holder portion to be retained in the position shown in FIGS. 15 and 15A so that blade 52 may be removed, rotated or replaced as described above for knife 10.

The skilled reader should note that the details of blade holder portion 442 that relate to receiving and holding blade 52 may be generally identical to those shown in FIGS. 8A-8F and as described above for blade holder portion 42. Further, the skilled reader should note that knife 410 may be adapted to receiving and holding a standard box cutter blade 152 (as shown in FIG. 6A) by modifying blade holder portion 442 so that it has the geometry for receiving and holding blade 152 as does blade holder portion 142.

Triangular blades 52 and 252 merit further explanation. Triangular blades 52 and 252 are particularly useful because they present six cutting edges. In the case of blade 252, the cutting edges are curved which affords certain advantages as the blade slices through material. One of the more useful features of blades 52 and 252 is that each edge is sequentially indicated with an indicator. The indicator may take the form of an Arabic numeral as shown or the form of letters of the alphabet or any other set of symbols that may be easily understood as indicating a logical sequence. Thus, when a user removes a blade as shown in FIG. 5A, the user can note the indicator next to the worn cutting edge in use and reposition the blade so that the next fresh cutting edge with the next indicator is in position for use.

Most of the foregoing components for knife 10 and knife 410 (with the obvious exceptions of cutting blades, springs and the various fasteners used to assemble knifes 10 and 410) may be most easily fashioned from injection molded plastic. However, some or all of these foregoing components may be fashioned from a cast metal such as cast aluminum or from other materials. Even machined materials may be possible, but may be relatively expensive.

It is to be understood that while certain forms of this invention have been illustrated and described, it is not limited thereto, except in so far as such limitations are included in the following claims and allowable equivalents thereof.

Having thus described the invention, what is claimed as new and desired to be secured by Letters Patent is:

1. A retractable blade knife, comprising:

a body, having a proximate end and a distal end;

a handle lever having a proximate end and a distal end;

a blade holder assembly including a blade including at least one cutting edge;

the blade holder assembly pivotably mounted to the body near the distal end of the body to pivot between a retracted position, in which the at least one cutting edge is covered by the body, and an extended position in which the at least one cutting edge is exposed for use;

the handle lever mounted to the body at a pivot joint located between the proximate and distal ends of both the handle lever and the body so that the handle lever can pivot between an open position and a closed position, the distal end of the handle lever mechanically in communication with the blade holder assembly, such that, when the handle lever is urged from the open position to the closed position, the blade holder assembly pivots from the retracted position to the extended position thereby exposing the at least one cutting edge; and wherein the blade holder assembly is adapted for being pivoted past the extended position by said handle lever to a blade changing position wherein a portion of the blade holder assembly is exposed to permit removal of the blade from the blade holder portion.

2. The retractable blade knife of claim 1, wherein:

the distal end of the handle lever includes a pin and the blade holder assembly includes a slot operable for receiving the pin defining the mechanical communication, the slot oriented such that when the handle lever is pivoted from the open position to the closed position, the pin pushes against the slot to cause the blade holder assembly to pivot from the retracted position to the extended position.

3. The retractable blade knife of claim 1, wherein:

the handle lever is biased toward the open position due to a spring located between said handle lever and said body.

4. The retractable blade knife of claim 1, wherein:

the blade is generally triangular with three corners and the at least one cutting edge is six cutting edges, wherein each of the corners is defined by a respective two of the six cutting edges.

5. The retractable blade knife of claim 4, wherein at least four of the six cutting edges are at least partially covered by the blade holder portion.

6. The retractable blade knife of claim 1, wherein:

the blade holder assembly includes a blade holder adapted to hold said blade; and blade.

7. The retractable blade knife of claim 6, wherein:

the body includes a blade lock tab that can be disengaged and that is initially engaged to prevent the blade holder assembly from pivoting to said blade changing position.

8. A retractable blade knife, comprising:

a body having a proximal end and a distal end;

a handle lever having a proximal end and a distal end and a transverse pin fixed near the distal end thereof, the handle lever mounted to the body at a pivot joint between the proximal and distal ends of the handle lever at a location that is also between the proximal and distal ends of the body, the handle lever mounted to the body so that the proximal end of the handle lever is oriented toward the proximal end of the body, the handle lever operable for pivoting in relation to the body about the pivot joint between an open position wherein the proximal end of the handle lever is displaced from the proximal end of the body and a closed position wherein the proximal end of the handle lever is generally less displaced from the proximal end of the body, the handle lever also biased towards the open position;

a blade holder assembly including a blade which includes at least one active cutting edge, the blade holder assembly mounted to the body at a blade holder pivot joint so that the blade holder assembly is operable for pivoting between a retracted position wherein the at least one active cutting edge is concealed within the body and an extended position wherein the at least one active cutting edge is exposed for use, the blade holder pivot joint disposed at the distal end of the body and spaced from said transverse pin of the handle lever, the blade holder assembly including a slot operable for slidably receiving the handle lever transverse pin, so that when urging pressure is applied to the handle lever causing the handle lever to pivot from the open position to the closed position, the handle lever pin urges rotation of the blade holder assembly from the retracted position to the extended position thereby exposing the at least one active cutting edge for use, and such that when urging pressure on the handle lever is released, the biased handle lever returns to the open position due to a spring located between said handle lever and said body, causing the blade holder to pivot from the extended position to the retracted position whereby the exposed at least one active cutting edge is safely concealed within the body; and wherein the blade holder assembly is adapted for being pivoted past the extended position by said handle lever to a blade changing position wherein a portion of the blade holder assembly is exposed to permit removal of the blade from the blade holder portion.

9. The retractable blade knife of claim 8, wherein:

the body includes a releasable blade lock tab releasably engaged with said blade holder assembly to prevent rotation of the blade holder assembly from the extended position further to the blade changing position.

10. The retractable blade knife of claim 8, wherein:

the body further includes a releasable latch member operable for releasably engaging a notch at the proximal end of the handle lever, the latch member operable for retaining the handle lever in the closed position thereby maintaining the blade holder assembly in the blade changing position.

11. A retractable blade knife, comprising:

a body;

a blade holder assembly including a blade holder portion and a removable blade, the blade holder assembly pivotably mounted to the body to pivot between a retracted position wherein the blade is enclosed within the body and an extended position wherein the blade is exposed for use;

a thumb tab including a pin which is received by a first slot in the body and which is releasably engaged with said blade holder assembly, such that the thumb tab can be pressed, thereby disengaging said thumb tab with said blade holder assembly, thereby causing the blade holder assembly to pivot from the retracted position to the extended position; and wherein the blade holder assembly is adapted for being pivoted past the extended position to a blade changing position wherein a portion of the blade holder assembly is exposed to permit removal of the blade from the blade holder portion.

12. The retractable blade knife of claim 11, wherein;

the blade holder assembly is biased toward the retracted position due to a spring located between said handle lever and said body.

13. The retractable blade knife of claim 11, wherein:

a removable locking tab is movably mounted to the body to move between a first position wherein the locking tab prevents the blade holder assembly from pivoting from the extended position to the blade changing position and second position wherein the locking tab does not prevent the blade holder assembly from pivoting from the extended position to the blade changing position.

14. The retractable blade knife of claim 11, wherein:

a removable locking tab is movably mounted to the body to move between a first position wherein the locking tab prevents the blade holder assembly from pivoting from the extended position to the blade changing position and second position wherein the locking tab does not prevent the blade holder assembly from pivoting from the extended position to the blade changing position; and an opening in the blade holder portion for receiving the pin of the thumb tab comprising a second slot oriented generally transversely to the first slot in the body, and the first slot includes a return channel that aligns with the second slot when the blade holder portion is in the blade changing position.

* * * * *